United States Patent [19]

Bock et al.

[11] Patent Number: 4,860,661

[45] Date of Patent: Aug. 29, 1989

[54] SABOTED PROJECTILE WITH PROPELLANT CAGE

[75] Inventors: Erich Bock, Nurnberg; Adolf Weber, Neunkirchen, both of Fed. Rep. of Germany

[73] Assignee: DIEHL GmbH & Co., Nurnberg, Fed. Rep. of Germany

[21] Appl. No.: 255,048

[22] Filed: Oct. 7, 1988

[30] Foreign Application Priority Data

Nov. 6, 1987 [DE] Fed. Rep. of Germany ..... 3737708

[51] Int. Cl.[4] ..... F42B 13/16

[52] U.S. Cl. ..... 102/523; 102/520; 102/529

[58] Field of Search ..... 102/520–523, 102/529

[56] References Cited

U.S. PATENT DOCUMENTS

| | | | |
|---|---|---|---|
| 2,788,744 | 4/1957 | Donner | 102/522 |
| 3,311,061 | 3/1967 | Roehrdanz | 102/522 |
| 3,496,869 | 2/1970 | Engel | 102/522 |
| 3,620,167 | 11/1971 | Romer et al. | 102/521 |
| 3,662,686 | 5/1972 | Baldini | 102/522 |
| 4,408,538 | 10/1983 | Deffayet et al. | 102/522 |
| 4,434,718 | 3/1984 | Kopsch et al. | 102/522 |
| 4,534,294 | 8/1985 | Laar et al. | 102/520 |

FOREIGN PATENT DOCUMENTS

| | | |
|---|---|---|
| 3201629 | 9/1982 | Fed. Rep. of Germany . |
| 3600469 | 7/1987 | Fed. Rep. of Germany . |
| 192623 | 8/1960 | Sweden . |

*Primary Examiner*—Harold J. Tudor

*Attorney, Agent, or Firm*—Scully, Scott, Murphy & Presser

[57] ABSTRACT

A sabot projectile with a propulsion mechanism for utilization in a liner for a barreled firing apparatus. In the projectile, the propellent cage for a projectile with a propulsion mechanism includes hinge-like segments articulated forwardly in the firing direction, which encompass the projectile about the circumference thereof and are rotatable therewith, inasmuch as the segments are held together through the intermediary of a retainer ring.

3 Claims, 2 Drawing Sheets

SABOTED PROJECTILE WITH PROPELLANT CAGE

BACKGROUND OF THE INVENTION

1. Field of the Invention

The present invention relates to a sabot projectile with a propellant cage adapted to be utilized within a liner for a barreled weapon or tube.

2. Discussion of the Prior Art

From the disclosure of German Pat. No. 32 01 629, a rotationally-stabilized practice projectile has become known in the technology. This projectile possesses the property that, up to a certain distance to a target, it conforms with the properties of a live or combat projectile. Thereafter, the projectile is imparted a curtailed range of flight. This is achieved through the intermediary of longitudinal ribs or fins which are arranged about the circumference of the practice projectile.

Furthermore, a sabot projectile with a propulsion mechanism has become known from the disclosure of German Laid-Open Patent Application No. 36 00 469. The projectile is arranged in a propellant cage, and radially supported within the propellant cage through the intermediary of a plurality of separate supporting levers.

In the simulation of fin-stabilized projectiles for large-caliber cannons, such as tank cannons; with regard to be able to attain the best possible correlation with the trajectory of a live or combat projectile which are fired on small firing ranges, it is an absolute prerequisite to dependably adhere to the necessary safety range.

Through the utilization of a saboted practice projectile which is equipped with fins pursuant to German Pat. No. 32 01 629, and a known liner for large-calibered cannons, an object of the present invention contemplates the provision of a sabot projectile with a propulsion which is adapted for the simulation of sub-calibered inertial projectiles.

SUMMARY OF THE INVENTION

The foregoing object of the invention is achieved through the provision of a sabot projectile with a propellant cage for use within the liner of a barreled weapon or tube, wherein, in the sabot projectile, the propellant cage for a projectile includes hinge-like segments articulated forwardly; in effect, in the firing direction, which encompasses the projectile about the circumference thereof and are rotatable therewith, inasmuch as the segments are held together through the intermediary of a retainer ring.

BRIEF DESCRIPTION OF THE DRAWINGS

Reference may now be had to the following detailed description of an exemplary embodiment of the invention, taken in conjunction with the accompanying drawings; in which.

DETAILED DESCRIPTION

Figure 1:
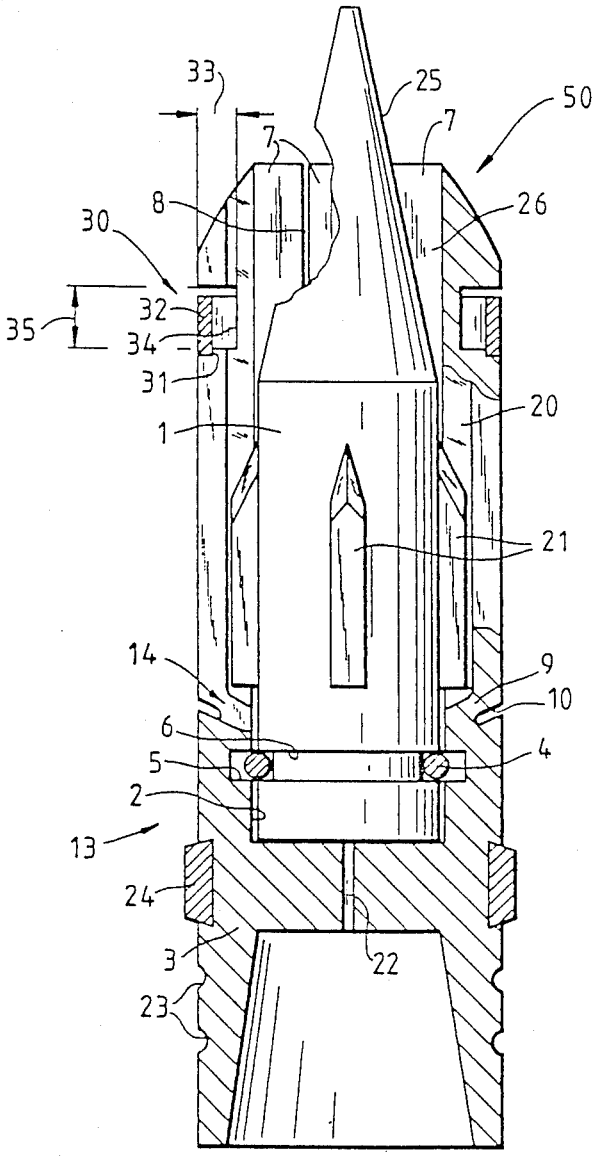
FIG. 1 illustrates, in a longitudinal partially-sectional view, a sabot projectile with a propellant cage in its loaded condition within a weapon barrel or launch tube.
Figure 2:
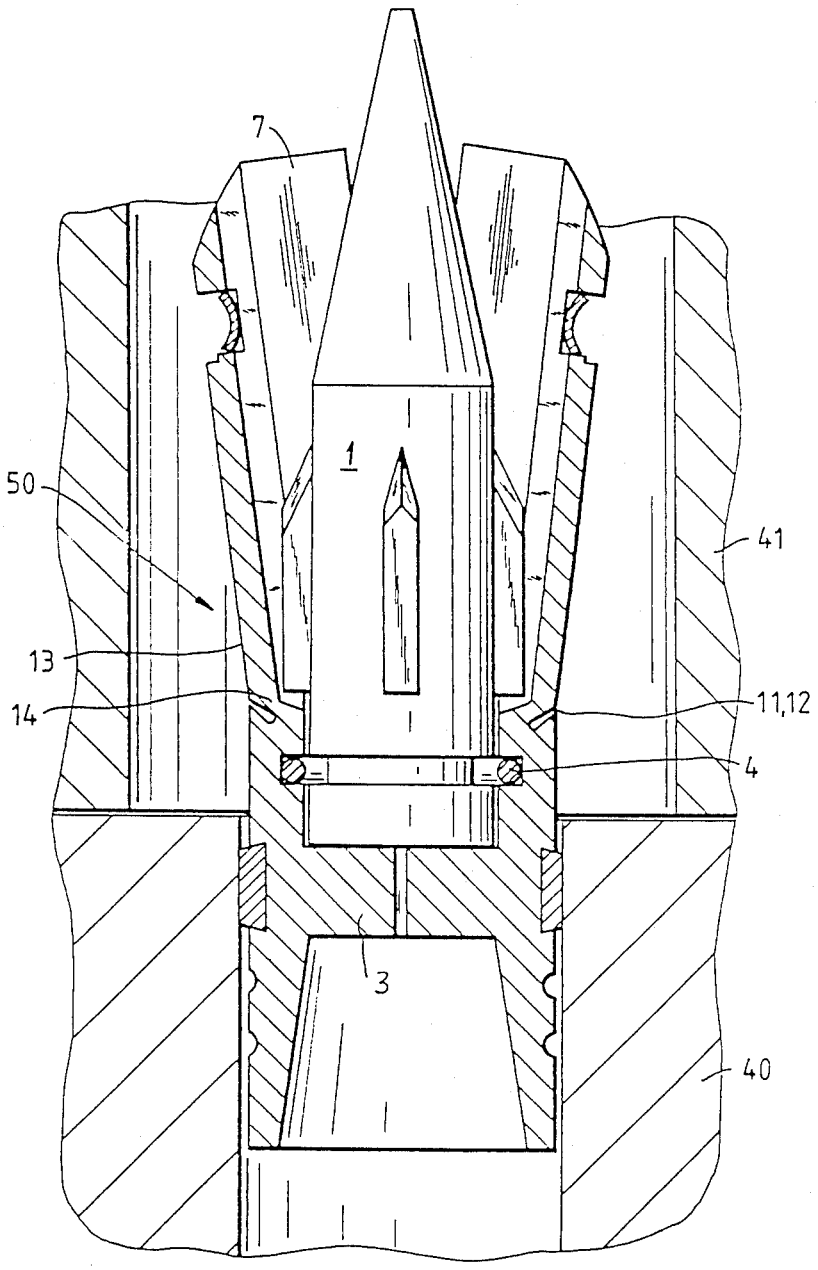
FIG. 2 illustrates the projectile of FIG. 1 during the passage thereof through a sabot-restraining liner.

A projectile member 1 of a sabot projectile with a propellant mechanism 50 is arranged within a propulsion arrangement 13; in essence, in a bore 2 of a propellant cage 3 which is constituted of aluminum, and axially fastened in position by a securing ring 4. The securing ring 4 engages into grooves 5 and 6. The projectile member 1 may be of a heavy-metal structure, such as tungsten carbide or a combination of tungsten-heavy metal.

Six segments 7, of which only three segments are visible in the drawing, are separated from each other through slots 8. Between the segments 7 and the propellent cage 3 there are provided hinge members 14; in essence, deformable sections 9 because of the formation of a conical annular gap 10. As a result of the annular gap 10, there is provided the presence of abutment surfaces 11 and 12. The segments 7 are each equipped with grooves 20 for the receipt of the fins 21 of the projectile member 1.

The projectile 1 possesses a caliber of 15 mm and is constituted of tungsten-carbide. The projectile is intended for a weapon barrel liner for a 120 mm tank cannon. A gas bore, ridges for the fastening of a propellent cartridge, and a guide band are respectively identified by reference numerals 22 through 24.

Between the segment 7 and a projectile nose cone 25 there is present a wedge-shaped annular space 26.

In the area of the annular space 26, the segments 7 are each provided with a groove 30 possessing a short step 31 for a retainer ring 32 which is fixed thereon, which may be either metal, plastic or a composite material, and is plastically-deformable. The retainer ring 32 lies within the contour of the segments 7 and the propellent cage 3, and during the acceleration of the projectile is pressed into the step 31 opposite the direction of acceleration.

The depth 33 of the groove 30 up to the abutment surface 34 corresponds to 3-times the thickness of the retainer ring 32. The length 35 is greater than the width of the retainer ring 32.

Upon the exit of the projectile with the propulsion mechanism 50 from the liner 40 for the weapon barrel or tube, the securing ring 4 has already unlatched the projectile 1, the retainer ring 32 has slid off from the step 31, and the dynamic pressure reigning with the annular space 26 has spread apart the segments 7 to cause deformation of the retainer ring 32.

The segments incorporate defined bending zones to allow for contact against the abutment surfaces 11 and 12 because of the hinge structures 14. The retainer ring 32 essentially constrains the outwardly bending segments 7 for the protection of a protective tube 41 which extends up to the muzzle of the cannon (not shown) and limits the spreading apart of the segments 7 in such a manner that, on the one hand, there is produced a significant increase in the size of the end surface of the propulsion mechanism 13; however, on the other hand, the segments cannot break off. Further support is provided by the abutment surfaces 11 and 12.

The propulsion mechanism 13 is configured in such a mode that, upon egress from the liner 40, no parts are able to fly off towards the sides. As a consequence thereof, any damage to the protective tube 41 is avoided, and also any damage to the weapon barrel and interferences with the projectile during its passage through the protective tube which is located within the weapon barrel.

The projectile 1 is spin-stabilized and, up to a certain distance to the target, possesses the best possible correlation in its trajectory or path of flight with a live or actual combat projectile. Due to the longitudinal fins 21 on the projectile, as has already been described in German Pat. No. 32 01 629, there is curtailed the trajectory thereof after passing of the distance to the target.

As a result thereof, this will facilitate the practice firing with a live, large-calibrated shot against small firing ranges while maintaining the safety range.

Essential for the invention is also the propulsion mechanism 13 consisting of only few parts with the securing ring 4, the guide band 24 and the retainer ring 32.

It is also essential that a limited spreading apart of the segments 7 already facilitates, through the retainer ring 32, the release of the projectile 1 within the protective tube 41. For this purpose it is also adequate to provide for a non-expandable retainer ring. In this connection, a suitable depth 33 of the groove 30 is considered to be adequate.

Independently of the selected inventive structure as set forth herein, it is essential to provide for:

1. The tight seating of the retainer ring 32 on the step, which is released when the segments 7 exit from the liner 40 and enters into the protective tube 41; and 2. The segments 7 with the abutment surfaces 11 and 12, which are articulated to the propellent cage 3 through the indestructible hinge structures 14.

The indicated calibers and materials can, without any difficulty, be correlated with applicable requirements.

The inventive concept also includes the aspect that a projectile which is constituted from heavy-metal can be employed as live battle ammunition.

What is claimed is:

1. A sabot projectile which is a practice projectile or a cannon combat projectile, for utilization within a liner for a weapon barrel, said projectile including a projectile member equipped with fins and a propellant cage for retaining said projectile member, said propellant cage including hinge-like segments articulated forwardly in the firing direction for said projectile, said segments circumferentially encompassing said projectile member; a retainer ring for holding said segments together such that said segment rotate in conjunction with said projectile member; said segments each having a groove formed therein, said retainer ring being arranged in said groove; said groove including a step for the support of the retainer ring in an initial position, and said groove having an abutment surface for said retainer ring at a depth providing for the formation of an open space for the unhindered spreading apart of the segments until contacting against the retainer ring; said step on the segments being located on an end surface of the groove facing towards a propellant charge for the projectile, and said retainer ring being constituted from an expandable plastically-deformable material selected from the group consisting of metal, plastic and composite materials.

2. Projectile as claimed in claim 1, wherein the propellant cage includes hinges for the segments, said hinges being formed through a conical annular gap at the base of the segments within the propellent cage.

3. Projectile as claimed in claim 2, wherein abutment surfaces are formed on the foot end of each of the segments and on the propellant cage for limiting the spreading apart of said segments.

* * * * *